US005403003A

United States Patent [19]

O'Hara et al.

[11] Patent Number: 5,403,003

[45] Date of Patent: Apr. 4, 1995

[54] ANCHOR-VALVE STEM ASSEMBLY FOR INFLATABLE BALL

[75] Inventors: Thomas K. O'Hara, Laguna Beach; Raymond W. Ferris, Rolling Hills, both of Calif.

[73] Assignee: Sipa Sipa, Inc., Torrance, Calif.

[21] Appl. No.: 105,460

[22] Filed: Aug. 11, 1993

[51] Int. Cl.[6] ..... A63B 41/00

[52] U.S. Cl. ..... 273/58 C; 273/65 D; 273/58 B

[58] Field of Search ..... 273/58 R, 58 B, 58 BA, 273/58 C, 58 H, 58 K, 65 A-65 D, 65 F

[56] References Cited

U.S. PATENT DOCUMENTS

| | | | |
|---|---|---|---|
| 2,731,028 | 1/1956 | McCord | 273/65 D |
| 3,220,729 | 11/1965 | Whittington | 273/58 C |
| 3,595,948 | 7/1971 | Cosani | 273/58 C |
| 4,162,790 | 7/1979 | Kelsey | 273/58 C |
| 4,192,044 | 3/1980 | Ballerini | 273/58 C |
| 4,568,081 | 2/1986 | Martin | 273/65 C |
| 4,986,540 | 1/1991 | Leslie | 273/58 H |

FOREIGN PATENT DOCUMENTS

| | | | |
|---|---|---|---|
| 1074306 | 3/1954 | France | 273/58 C |
| 2108855 | 5/1983 | United Kingdom | 273/58 C |

*Primary Examiner*—Vincent Millin
*Assistant Examiner*—Steven B. Wong
*Attorney, Agent, or Firm*—Stetina Brunda & Buyan

[57] ABSTRACT

An anchor-valve stem assembly has a valve stem, having a bore formed therethrough and a valve formed within the valve stem, preferably a check valve. At least one attachment member or anchor is formed upon the valve stem so as to facilitate attachment to at least one tether, preferably formed of elastic. The anchor(s) preferably comprise generally cylindrical arms and are preferably formed integrally with the valve stem. A cap is optionally attached, preferably via a tether, to the valve stem so as to close the bore thereof. The use of such an anchor-valve stem assembly facilitates the efficient fabrication of inflatable items such as balls to which it is desirable to attach at least one tether.

35 Claims, 1 Drawing Sheet

ANCHOR-VALVE STEM ASSEMBLY FOR INFLATABLE BALL

FIELD OF THE INVENTION

The present invention relates generally to inflatable toys and more particularly to an anchor-valve stem assembly for an inflatable ball having at least one tether attached thereto.

BACKGROUND OF THE INVENTION

Inflatable items, particularly toys, are well known. Such inflatable items commonly comprise balls, floats, and air mattresses, as well as a wide variety of fanciful and realistic inflatable animals.

Inflatable balls include those which are intended for free use, i.e., throwing, kicking, bouncing, etc., as well as those which are tethered and intended for use in specific games. One example of such a tethered ball is the common tether ball, which is attached via a non-elastic tether to a pole wherein each of two players attempts to cause the ball to wrap around the pole in each of two different directions. Conventional tethered balls comprise separate attachment members or anchors for facilitating attachment thereof to the tether and valve stems for facilitating filling of the ball with air. Typically, the anchor comprises a loop or eyelet formed of a durable plastic through which the tether is tied. The attachment member is typically formed as a portion of, or attached directly to, the ball.

Various different stem arrangements, i.e., check valves, for filling and discharging air from such inflatable items are well known. Such valve stems typically comprise a hollow elongate member having a check valve, i.e., a duckbill valve disposed at the inner end thereof, such that air may be forced through the valve stem to inflate the inflatable item and the air remains therein until the duckbill valve is manually maintained in an open position so as to facilitate discharging of the air from within the inflatable item.

The duckbill valve is maintained in an open position to facilitate discharging of the air. The duckbill valve may be maintained in an open position via deformation thereof, i.e., by manually compressing or deforming the valve stem or by inserting an elongate member through the valve stem so as to prevent sealing of the check valve.

Occasionally it is desirable to attach a tether to a ball having a thin wall which prohibits exterior attachment of an anchor thereto in the manner of a contemporary tether ball. Such thin-wall construction is utilized in inflatable balls which are intended to be utilized in games wherein a player attempts to strike an opponent with the ball. Such thin-wall construction makes the ball more resilient, and thus less likely to cause pain or injury upon impact.

It is generally desirable to form thin-walled balls via low cost rotocasting. However, an anchor cannot be formed directly on a thin-walled ball via the rotocasting method since rotocasting results in a substantially even, i.e., uniform thickness, deposition of material about the surface of the mold. Since it is desirable to form the anchor of a greater wall thickness (or even as a solid member) than the thin-walled ball itself, rotocasting is unable to accomplish such construction. As such, thin-walled tether balls and the like cannot be rotocast as an integral unit. Thus, contemporary thin-walled balls are typically formed by attaching a separately fabricated anchor to a rotocast thin-walled ball.

However, such thin-wall construction necessitates that the forces generated at the attachment point during use be spread over a larger area, so as to reduce the stresses induced thereby and consequently reduce the probability of damaging the ball during use. Thus, a means for attaching one or more tethers to a ball having thin-wall construction is desirable. Such construction is particularly desirable wherein the anchor is combined with the inflation valve stem assembly so as to facilitate the use of a tether with a contemporary ball, without modification thereof, Furthermore, the use of separate anchors and valve stem assemblies increases the cost of the inflatable item by requiring the purchase and assembly of both items into the finished product. Thus, although such contemporary inflatable items having separate anchors and valve stem assemblies have proven generally suitable for their intended purposes, they possess inherent deficiencies which detract from their overall effectiveness in the marketplace.

SUMMARY OF THE INVENTION

The present invention specifically addresses and alleviates the above-mentioned deficiencies associated with the prior art. More particularly, the present invention comprises an anchor-valve stem assembly which functions both as a means for inflating an inflatable item and as a means for attaching at least one tether thereto. The anchor-valve stem assembly comprises a valve stem, having a bore formed therein, and having a valve formed within the bore for controlling the flow of air therethrough. The valve preferably comprises a check valve, preferably a duckbill check valve. At least one attachment member or anchor is formed upon the valve stem so as to facilitate attachment of the inflatable item to at least one tether. Each anchor preferably comprises a generally cylindrical, outwardly extending arm having a curved distal end. Each anchor is preferably formed as an integral portion of the valve stem. A cap may optionally be attached, preferably via a short tether, to the valve stem so as to close the outer opening thereof. The use of such an anchor-valve stem assembly according to the present invention facilitates the efficient fabrication of inflatable items, such as balls, to which at least one tether is to be attached.

An inside stop is formed upon the valve stem proximate the inside opening of its bore and an outside stop is formed upon the valve stem proximate the outside opening thereof. The inside and outside stops are configured to capture a skirt or washer and a support surface, i.e., a portion of the inflatable item therebetween.

During assembly, the washer is disposed around the valve stem and may be folded upward toward the anchor members so as to expose a length of the valve stem such that the valve stem may readily be inserted into the inflatable item. After insertion, the washer is folded back down into its operative position.

In the preferred embodiment of the present invention, the inflatable item comprises a ball which is formed by rotocasting. A sleeve insert is placed into the mold prior to rotocasting such that the ball formed thereby is integrally formed to the sleeve. The valve stem of the present invention is inserted through the sleeve such that the sleeve provides an area of reinforcement about the valve stem. Those skilled in the art will recognize that various other means for providing such reinforcement are likewise suitable.

In the preferred embodiment of the present invention the anchor-valve stem assembly is utilized in an inflatable ball having two elastic tethers attached at their proximal ends thereto. The distal ends of the tethers attach to wrist straps such that, when used, neither elastic tether may be released by one player, potentially injuring the other player.

To use the inflatable ball having an anchor-valve stem of the present invention, the two elastic tethers are stretched straight between the two players, with the inflatable ball hanging midway therebetween. Each of the two players then attempt to manipulate the inflatable ball so as to cause it to contact the other player, thereby winning a point. The inflatable ball is manipulated by varying the tension on the elastic tether so as to cause the inflatable ball to move back and forth between the two players.

A tapered plug is utilized to attach each elastic tether to its associated wrist strap. A tapered pocket formed within each wrist strap receives the tapered plug. An anchor extends from the tapered plug. The elastic tether is attached to the anchor in the same manner that the elastic tether is attached to the anchors of the anchor-valve stem assembly. The tapered plug and the tapered pocket of the wrist strap are configured such that applying tension to the anchor extending from the tapered plug causes the tapered plug to wedge more firmly within the tapered pocket of the wrist strap.

Thus, the preferred embodiment of the present invention facilitates the use of a contemporary, thin-walled ball without modification. The anchor-valve stem assembly is merely used in place of a contemporary valve assembly, thus providing both for the inflation of the ball and for attachment thereto to one or more tethers. The forces induced during use of the ball are distributed over a large area by inside and outside stops formed upon the valve stem which preferably cooperate with the reinforcing sleeve insert formed integrally with the ball and with the washer disposed about the anchor-valve stem outside of the ball. The washer distributes such forces over a greatly increased surface area of the ball, thus substantially mitigating the potential for damaging the ball during use thereof. Thus, the stresses induced by such forces are spread over an area of increased wall thickness of the ball, thus substantially mitigating the likelihood of failure during use.

These, as well as other, advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed Within the spirit and scope of the invention.

Figure 1:
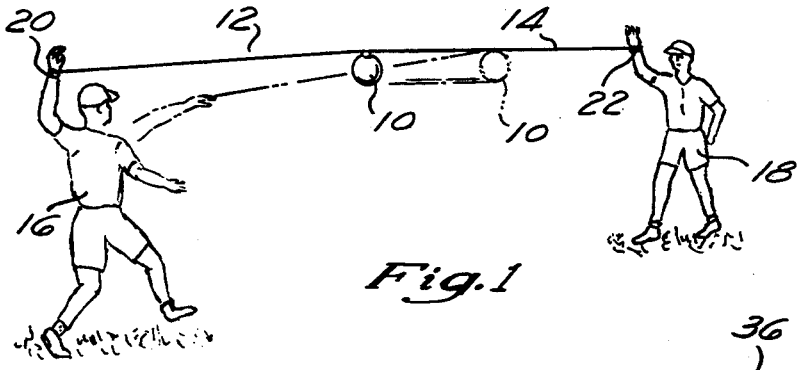
FIG. 1 is a perspective view illustrating use of the preferred embodiment of the anchor-valve stem assembly for the inflatable ball of the present invention.

The anchor-valve stem assembly for the inflatable ball of the present invention is illustrated in FIGS. 1–6 of the drawings which depict a presently preferred embodiment of the invention. Referring now to FIG. 1, in the preferred embodiment of the present invention the anchor-valve stem assembly is utilized in an inflatable ball 10 to which first 12 and second 14 elastic tethers are attached such that the distal ends of the first 12 and second 14 tethers may be manipulated by first 16 and second 18 players. A first wrist strap 20 attaches the distal end of the first elastic tether 12 about the wrist of the first player 16 and, in a similar fashion, a second wrist strap 22 attaches the second elastic tether 14 about the wrist of the second player 18.

The preferred embodiment of the present invention may thus be utilized to play a game wherein two players manipulate the distal ends of the first 12 and second 14 elastic tethers so as to effect movement of the inflatable ball 10 in an attempt to cause the inflatable ball 10 to contact the other player. Thus, each player may pull or release tension upon his respective elastic tether 12 or 14 in an attempt to effect a desired motion of the inflatable ball 10 which will result in the inflatable ball 10 striking the opposing players 16 or 18.

Figure 2:
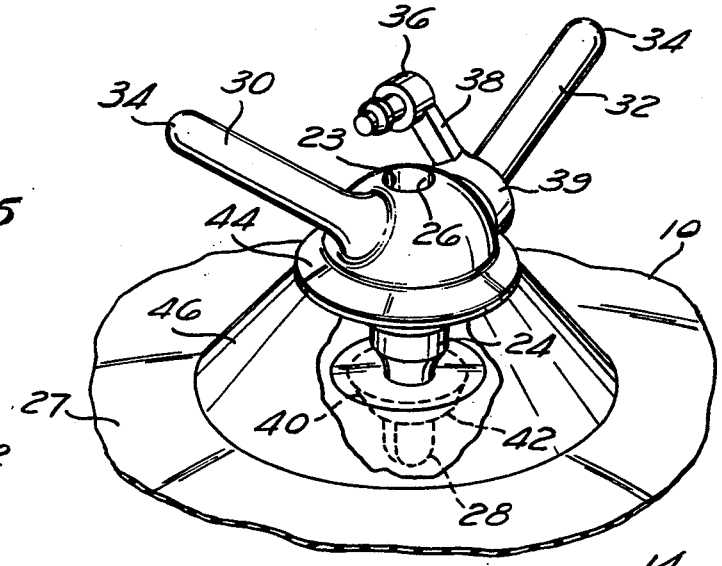
FIG. 2 is an enlarged perspective view of the anchor-valve stem assembly of the present invention.
Figure 3:
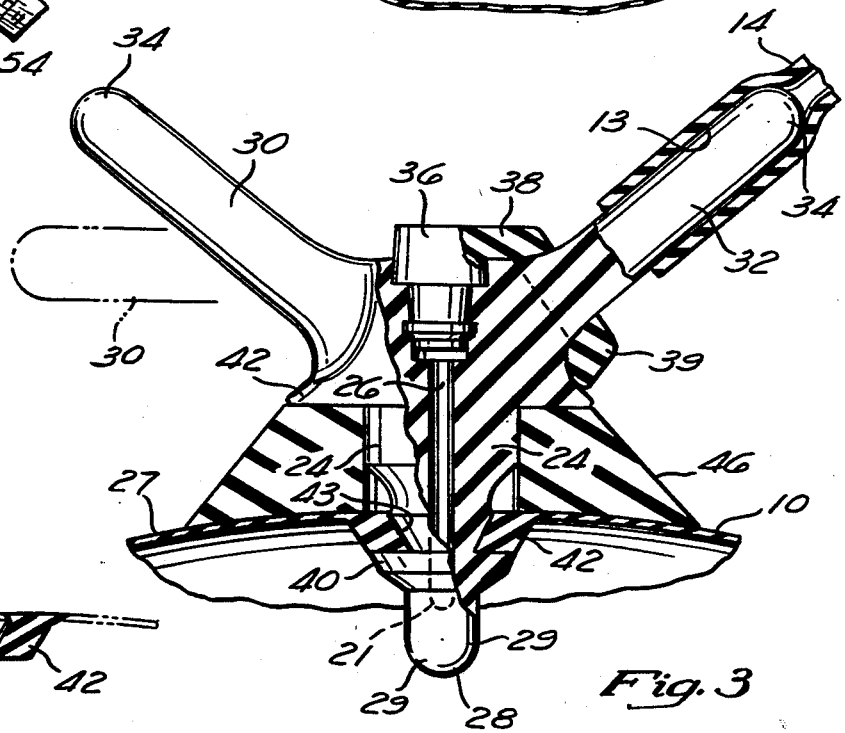
FIG. 3 is an enlarged side view, partially in cross-section, of the anchor-valve stem assembly of FIG. 2.
Figure 4:
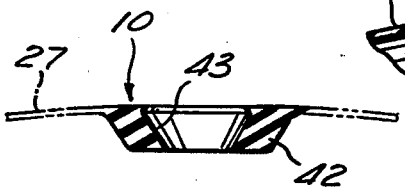
FIG. 4 is an enlarged cross-sectional view of the sleeve insert of FIGS. 2 and 3.

Referring now to FIGS. 2–4, the anchor-valve stem assembly of the present invention generally comprises a valve stem 24 which is inserted through a support surface 27 of an inflatable item, i.e., the ball 10. The valve stem 24 comprises a bore 261formed therethrough and a check valve, preferably a duckbill valve 28, in fluid communication with the bore 26 for controlling the flow of air into and out of the inflatable item or ball 10. First 30 and second 32 elongate, generally cylindrical anchors are formed upon the valve stem 24 and extend outwardly therefrom such that the first 12 and second 14 elastic tethers may be attached thereto.

In the preferred embodiment of the present invention the first 12 and second 14 elastic tethers comprise elastic tubing which is slipped over the first 30 and second 32 anchors, thereby effecting secure attachment thereto. As those skilled in the art will recognize, secure attachment is achieved due to the Poisson contraction which results when the elastic tubing or tether 12 or 14 is pulled. That is, applying tension to the elastic tether 12 or 14 causes that portion of the elastic tether 12 or 14 within which the elongate cylindrical anchor 30 or 32 is received to attempt to contract in diameter, thereby causing the elastic tether 12 or 14 to more firmly grip the anchor 30 or 32. Each anchor 30 or 32 preferably comprises a rounded tip 34 formed at the distal end thereof to facilitate insertion of the anchor 30 or 32 within the bore of the elastic tubing comprising the first 12 and second 14 elastic tethers.

A plug or cap 36, preferably attached to one of the anchors 30 or 32 via a short tether 38, is optionally provided so as to plug the bore 26, thereby preventing the undesirable introduction of soil or other contaminants. The tether 38 is preferably attached to an anchor 30 or 32 via annulus or collar 39 disposed thereabout.

An inside stop 40 formed about the inner portion of the valve stem 24 abuts an annular sleeve 42 formed in the support surface 27 of the inflatable item or ball 10. The sleeve 42 has a bore 43 formed therein such that the valve stem 24 is disposed within the bore 43 of the sleeve 42. In a similar fashion, an outside stop 44 abuts an annular skirt or washer 46 which then abuts the support surface 27 of the ball 10. Thus, the sleeve 42 and the support surface 26 are captured intermediate the inside 40 and outside 44 stops of the valve stem 24, thereby securely attaching the valve stem 24 to the inflatable item-or ball 10.

The sleeve 42 is preferably formed as an integral portion of the support surface 26 of the inflatable item or ball 10. In the preferred embodiment of the present invention, the ball 10 is preferably formed by rotocasting wherein the sleeve 42 is inserted into the mold prior to the rotocasting process such that the support surface is formed directly thereto during the rotocasting process. Those skilled in the art will recognize that various other means for attaching the sleeve 42 to the support surface 27 of an inflatable item are likewise suitable. The sleeve 42 provides an area of reinforcement to the support surface 27, to facilitate attachment of the valve stem 24 to the inflatable item or ball 10.

The skirt or washer 46 is preferably formed as a separate item which is then inserted over the valve stem 24 prior to attachment of the valve stem 24 to the inflatable item or ball 10. To attach the valve stem 24 to the ball 10, the washer 46 is first peeled back so as to expose a sufficient length of the valve stem 24 such that it may readily be inserted through the sleeve 42 in a manner which allows the inside stop 40 to extend completely through the sleeve 42. After the valve stem 24 has been inserted through the sleeve 42, the washer 46 is released such that it attains the final configuration illustrated in FIGS. 2 and 3 of the drawings.

Figure 5:
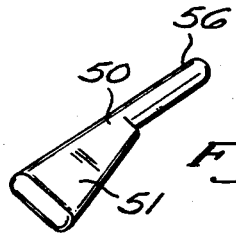
FIG. 5 is a perspective view of a tapered plug used to attach an elastic tether to a wrist strap according to the present invention.
Figure 6:
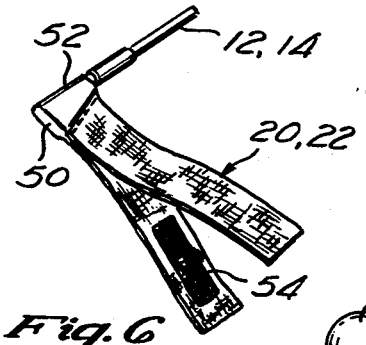
FIG. 6 is a perspective view illustrating attachment of a wrist strap to an elastic tether utilizing the tapered plug of FIG. 5.

Referring now to FIGS. 5 and 6, attachment of the first 12 and second 14 elastic tethers to the wrist band 22 is accomplished via tapered plugs 50 which are received within complimentary tapered pockets 521 formed in each wrist band 22. Each tapered plug 50 comprises a tapered body portion 51.

Each wrist band 22 preferably comprises nylon webbing of sufficient length to extend about a user's wrist and hook and loop fasteners 54 configured to allow adjustable attachment of the wrist band 22 to the user's wrist. The tubing comprising the first 12 and second 14 elastic tethers is attached to an anchor 56 formed upon the tapered plugs 50 in a manner similar to the attachment thereof to the first 30 and second 32 anchors of the anchor-valve stem assembly.

Attachment of the first 12 and second 14 elastic tethers to their respective wrist straps 20 and 22 thus merely involves insertion of a tapered plug 50 into the tapered pocket 52 of the wrist strap 22 and attachment of the elastic tether 12 or 14 to the anchor 56 thereof. The taper of the body portion 51 of the tapered plug 50 prevents the tapered plug 50 from being pulled through the tapered pocket 52 during use.

In use, the anchor-valve stem of the present invention facilitates inflation of the inflatable item or ball 10 by first removing the cap 36 from the bore 26 and then blowing air through the bore 26 of the valve stem 24, as is common with such inflatable items. The duckbill check valve 28 prevents leakage of air from the inflatable item or ball 10 until such a time that the duckbill check valve 28 is manually deformed, i.e., typically via the insertion of an elongate tool therethrough, thereby separating the two sealing members 29 of the duckbill check valve 28 and allowing air to escape through the bore 26.

Attachment of the first 12 and second 14 elastic tethers to the first 30 and second 32 anchors, respectively, may be accomplished by first wetting the first 30 and second 32 anchors and then pushing the proximal ends of the first 12 and second 14 elastic tethers thereover such that the first 30 and second 32 anchors are received within the bore 13 of each elastic tether 12 and 14 (as seen in FIG. 3).

As such, the anchor-valve stem assembly for the inflatable ball of the present invention facilitates the use of contemporary thin balls, preferably having a reinforcing sleeve 42 insert formed integrally therewith, in a manner which substantially mitigates the probability of failure occurring due to the forces induced during play. Such forces are spread over an increased area, preferably having an increased wall thickness due to the use of the sleeve 42. Integrating the first 30 and second 32 anchors with the valve stem 24 eliminates the need for separately formed anchors in order to facilitate the attachment of the tethers.

It is understood that the exemplary anchor-valve stem assembly for the inflatable ball of the present invention described herein and shown in the drawings represents only a presently preferred embodiment thereof. Indeed, various modifications and additions may be made to such embodiment without departing from the spirit and scope of the invention. For example, any desired number of anchors may be provided upon the valve stem to facilitate the attachment of a corresponding number of tethers or the like thereto. Indeed, various different configurations of the anchors are contemplated. For example, the anchors may comprise eyelets, hooks, or various other attachment means. Thus, these and other modifications and additions may be obvious to those skilled in the art and may be implemented to adapt the present invention for use in a variety of different applications.

What is claimed is:

1. An anchor-valve stem assembly comprising:

(a) a valve stem, said valve stem having a bore formed therein, said bore having inside and outside openings;

(b) a valve formed within said valve stem;

(c) at least one attachment member being formed upon said valve stem so as to facilitate attachment thereof to at least one tether; and (d) inside and outside stops formed upon said valve stem and configured to capture a support surface therebetween.

2. The anchor-valve stem assembly as recited in claim 1 wherein said attachment member(s) comprise generally cylindrical arms.

3. The anchor-valve stem assembly as recited in claim 1 wherein said attachment member(s) comprise eyelets.

4. The anchor-valve stem assembly as recited in claim 1 wherein said valve comprises a check valve.

5. The anchor-valve stem assembly as recited in claim 1 wherein said valve comprises a duckbill check valve.

6. The anchor-valve assembly as recited in claim 1 wherein said valve stem and said attachment member(s) are integrally formed.

7. The anchor-valve stem assembly as recited in claim 1 further comprising a cap, the cap being attachable to said valve stem so as to close the outer opening thereof.

8. The anchor-valve stem assembly as recited in claim 7 further comprising a tether attached to said cap and also attached to an attachment member.

9. The anchor-valve stem assembly as recited in claim 1 further comprising a washer disposed around said valve stem intermediate said inside and outside stops thereof.

10. A toy comprising:

(a) a ball;

(b) an anchor-valve stem formed upon said ball, said anchor-valve stem comprising:

(i) a valve stem, said valve stem having a bore formed therein, said bore having inside and outside openings;

(ii) a valve formed within said valve stem;

(iii) at least one attachment member being formed upon said valve stem so as to facilitate attachment thereof to at least one tether;

(iv) inside and outside stops formed upon said valve stem and configured to capture a portion of said ball therebetween; and (c) at least one tether attached to said attachment members.

11. The toy as recited in claim 10 wherein said attachment member(s) comprise generally cylindrical arms extending from said valve stem.

12. The toy as recited in claim 10 wherein said attachment member(s) comprise eyelets.

13. The toy as recited in claim 10 wherein said valve comprises a check valve.

14. The toy as recited in claim 10 wherein said valve comprises a duckbill check valve.

15. The toy as recited in claim 10 wherein said valve stem and said attachment member(s) are integrally formed.

16. The toy as recited in claim 10 further comprising a cap, the cap being attachable to said valve stem so as to close the outer opening thereof.

17. The anchor-valve stem assembly as recited in claim 16 further comprising a tether attached to said cap and also attached to an attachment member.

18. The toy as recited in claim 10 further comprising a washer disposed around said valve stem intermediate said inside and outside stops thereof.

19. The toy as recited in claim 10 wherein the portion of said ball captured intermediate said inside stop and said outside stop comprises a reinforcing sleeve.

20. The toy as recited in claim 10 wherein:

(a) said at least one attachment member comprises generally cylindrical arms extending from said valve stem; and (b) said at least one tether comprises two elastic tubes, each elastic tube having proximal and distal ends, one elastic tube being attached at its proximal end to each of said arms by receiving each of said arms therein.

21. The toy as recited in claim 20 further comprising a wrist strap attached to the distal end of each tether, for securing each tether to a player's wrist.

22. The toy as recited in claim 21 wherein said wrist straps comprise hook and loop fasteners.

23. The toy as recited in claim 21 further comprising:

(a) a tapered pocket formed in each of said wrist straps, said tapered pocket having a large end and a small end;

(b) a tapered plug disposed in each of said pockets, said tapered plug having a large end and a small end;

(c) a generally cylindrical arm extending from the small end of each of said tapered plugs and extending through the small opening in each of said tapered pockets; and (d) wherein the distal ends of said elastic tubing receive said arms of said tapered plugs, said tapered pocket has a large opening at a large end thereof and also has a small opening at a small end thereof.

24. A method for attaching a tether to an inflatable item, said method comprising the steps of:

(a) attaching a valve stem to the inflatable item by capturing a portion of the inflatable item intermediate two stops formed upon the valve stem;

(b) attaching the tether to an attachment member, the attachment member being formed upon a valve stem; and (c) wherein attachment of the tether to the attachment member formed upon the valve stem eliminates the requirement for a separate attachment member.

25. The method as recited in claim 24 wherein the step of attaching a tether to an attachment member comprises receiving a generally cylindrical arm extending from the attachment member into an elastic tube defining the tether.

26. An anchor-valve stem assembly comprising:

(a) a valve stem, said valve stem having a bore formed therein, said bore having inside and outside openings;

(b) a valve formed within said valve stem;

(c) at least one attachment member being formed upon said valve stem so as to facilitate attachment thereof to at least one tether;

(d) a cap, the cap being attachable to said valve stem so as to close the outer opening thereof; and (e) a tether attached to said cap and also attached to one of said attachment members.

27. An anchor-valve stem assembly comprising:

(a) a valve stem, said valve stem having a bore formed therein, said bore having inside and outside openings;

(b) a valve formed within said valve stem;

(c) at least one attachment member being formed upon said valve stem so as to facilitate attachment thereof to at least one tether;

(d) a washer disposed around said valve stem intermediate the inside and outside openings of the bore thereof;

(f) an inside stop formed upon said valve stem proximate the inside opening of the bore;

(g) an outside stop formed upon said valve stem proximate the outside opening of the bore; and (h) wherein said inside and outside stops are configured to capture said washer and a support surface therebetween.

28. A toy comprising:

(a) a ball;

(b) an anchor-valve stem formed upon said ball, said anchor-valve stem comprising:

(i) a valve stem, said valve stem having a bore formed therein, said bore having inside and outside openings;

(ii) a valve formed within said valve stem;

(iii) at least one attachment member being formed upon said valve stem so as to facilitate attachment thereof to at least one tether;

(iv) a cap, the cap being attachable to said valve stem so as to close the outer opening thereof;

(v) a tether attached to said cap and also attached to an attachment member; and (c) at least one tether attached to said attachment members.

29. A toy comprising:

(a) a ball;

(b) an anchor-valve stem formed upon said ball, said anchor-valve stem comprising:

(i) a valve stem, said valve stem having a bore formed therein, said bore having inside and outside openings;

(ii) a valve formed within said valve stem;

(iii) at least one attachment member being formed upon said valve stem so as to facilitate attachment thereof to at least one tether;

(iv) a washer disposed around said valve stem intermediate the inside and outside openings of the bore thereof;

(v) an inside stop formed upon said valve stem proximate the inside opening of the bore;

(vi) an outside stop formed upon said valve stem proximate the outside of said valve stem;

(vii) wherein said inside and outside stops are configured to capture said washer and a portion of said ball therebetween; and (c) at least one tether attached to said attachment members.

30. The toy as recited in claim 29 wherein the portion of said ball captured intermediate said inside stop and said outside stop comprises a reinforcing sleeve.

31. A toy comprising:

(a) a ball;

(b) an anchor-valve stem formed upon said ball, said anchor-valve stem comprising:

(i) a valve stem, said valve stem having a bore formed therein, said bore having inside and outside openings;

(ii) a valve formed within said valve stem;

(iii) at least one attachment member being formed upon said valve stem so as to facilitate attachment thereof to at least one tether, said at least one attachment member comprising generally cylindrical arms extending from said valve stem; and (c) at least one tether attached to said attachment members, said at least one tether comprising two elastic tubes, each elastic tube having proximal and distal ends, one elastic tube being attached at its proximal end to each of said arms by receiving each of said arms therein.

32. The toy as recited in claim 31 further comprising a wrist strap attached to the distal end of each tether, for securing each tether to a player's wrist.

33. The toy as recited in claim 32 wherein said wrist straps comprise hook and loop fasteners.

34. The toy as recited in claim 32 further comprising:

(a) a tapered pocket formed in each of said wrist straps, said tapered pocket having a large end and a small end and having a large opening at the large end thereof and having a small opening at the small end thereof;

(b) a tapered plug disposed in each of said pockets, said tapered plug having a large end and a small end;

(c) a generally cylindrical arm extending from the small end of each of said tapered plugs and extending through the small opening in each of said tapered pockets; and (d) wherein the distal ends of said elastic tubes each receive one of said arms of said tapered plugs therein.

35. A method for attaching a tether to an inflatable item, said method comprising the steps of:

(a) attaching the tether to an attachment member, the attachment member being formed upon a valve stem of the inflatable item, the tether being attached to the attachment member by receiving a generally cylindrical arm extending from the attachment member into an elastic tube defining the tether; and (b) wherein attachment of the tether to the attachment member formed upon the valve stem eliminates the requirement for a separate attachment member.

* * * * *